US005202072A

United States Patent [19]

Ross et al.

[11] Patent Number: 5,202,072

[45] Date of Patent: * Apr. 13, 1993

[54] PITCH CARBON FIBER SPINNING PROCESS

[75] Inventors: Roger A. Ross, Chattanooga; Uel D. Jennings, Signal Mountain, both of Tenn.

[73] Assignee: E. I. du Pont de Nemours and Company, Wilmington, Del.

[ * ] Notice: The portion of the term of this patent subsequent to Dec. 8, 2009 has been disclaimed.

[21] Appl. No.: 606,675

[22] Filed: Oct. 31, 1990

Related U.S. Application Data

[63] Continuation-in-part of Ser. No. 311,511, Feb. 16, 1989, abandoned.

[51] Int. Cl.[5] ..... B29C 47/12

[52] U.S. Cl. ..... 264/177.13; 264/29.2; 264/83; 264/211.11; 264/211.14

[58] Field of Search ..... 264/29.2, 29.1, 176.1, 264/177.17, 211.11, 83, 211.14, 177.13

[56] References Cited

U.S. PATENT DOCUMENTS

| | | | |
|---|---|---|---|
| 4,331,620 | 5/1982 | Diefendorf et al. | 264/29.2 |
| 4,376,747 | 3/1983 | Nazen | 264/176 F |
| 4,480,977 | 11/1984 | Nazen | 425/192 C |
| 4,511,625 | 4/1985 | Nazen et al. | 428/401 |
| 4,524,042 | 6/1985 | Genba et al. | 264/211 |
| 4,576,811 | 3/1986 | Riggs et al. | 423/447.2 |
| 4,628,001 | 12/1986 | Sasaki et al. | 428/367 |
| 4,717,331 | 1/1988 | Maeda et al. | 425/467 |
| 4,775,589 | 10/1988 | Hanada et al. | 428/367 |
| 4,814,121 | 3/1989 | Watanabe | 264/29.2 |
| 4,818,449 | 4/1989 | Yamada et al. | 264/29.2 |
| 4,818,612 | 4/1989 | Hara et al. | 428/367 |
| 4,837,076 | 6/1989 | McCullough, Jr. et al. | 428/224 |
| 4,859,381 | 8/1989 | Morita et al. | 264/29.2 |
| 4,859,382 | 8/1989 | Haraguchi et al. | 264/29.2 |
| 4,913,889 | 4/1990 | Takai et al. | 423/447.1 |

FOREIGN PATENT DOCUMENTS

| | | |
|---|---|---|
| 0263358 | 4/1988 | European Pat. Off. . |
| 0294112 | 12/1988 | European Pat. Off. . |
| 2614504 | 10/1977 | Fed. Rep. of Germany . |
| 2554834 | 5/1985 | France . |
| 168127 | 9/1984 | Japan . |
| 61-75820 | 4/1986 | Japan . |
| 61-75821 | 4/1986 | Japan . |
| 61-113828 | 5/1986 | Japan . |
| 63-105116 | 5/1988 | Japan . |
| 63-303121 | 12/1988 | Japan . |
| 62-131034 | 6/1987 | D.P.R. of Korea . |

*Primary Examiner*—Donald P. Walsh
*Assistant Examiner*—Ngoclan T. Mai

[57] ABSTRACT

Use of a ribbon shaped flow configuration at the entrance to a round spinneret used for spinning carbon fibers from mesophase pitch promotes the formation of random microstructure and prevents formation of axial cracking in the fibers.

11 Claims, 1 Drawing Sheet

PITCH CARBON FIBER SPINNING PROCESS

This application is a continuation-in-part of U.S. Ser. No. 07/311,511, filed Feb. 16, 1989, now abandoned.

BACKGROUND OF THE INVENTION

This invention relates to a process for producing pitch carbon fibers which avoids formation of cracks which run in the axial direction of the fibers.

It is well recognized in the prior art that carbon fibers prepared from pitch can be subject to axial cracking which decreases the fibers' strength, and thus their utility and value. The source of the cracking has been identified as fiber microstructure which is radial in nature rather than either random or "onion skin". See U.S. Pat. No. 4,504,454 for a description and drawings and photos of the cracking phenomenon and various fiber microstructures. There have been several approaches to the resolution of this problem reported in the art. U S. Pat. No. 4,504,454 concentrates on spinning conditions. Other references such as U.S. Pat. No. 4,331,620, U.S. Pat. No. 4,376,747, and U.S. Pat. No. 4,717,331 focus on the placing of inserts in the spinneret which yield modification of pitch flow in the spinneret to produce the desired nonradial microstructure in the fiber. Operation of spinnerets with moving parts on a commercial scale is very difficult. Similarly, maintaining continuity and uniformity of fibers spun from spinnerets having particulate or other very fine porous structures inside the spinneret is a very difficult task on a commercial scale.

Another approach to the problem has been to alter the geometry of the spinneret itself. See for example U.S. Pat. No. 4,576,811 and U.S. Pat. No. 4,628,001, as well as Japanese patent applications Kokai 61(1986)-75820 and 75821, as well as Japanese patent application 168127-1984. The '811 patent maintains a typical spinneret geometry, but examined the effects of various modifications of internal angles :n the zone which joins the counterbore and capillary. The '001 patent describes the use of non-round spinnerets and produces mostly non-round fibers, which may be less desirable for some applications. While strong fibers are produced, including some round small diameter fibers, the use of non-round spinnerets might present manufacturing or operating difficulties. The Japanese applications describe spinnerets which provide variation in cross-sectional area through which the pitch passes. These spinnerets can produce round fibers, but the non-conventional spinneret profile can lead to difficulties in manufacturing the spinnerets, and in cleaning them.

This invention is capable of producing generally round cross-section fibers with spinnerets which are relatively simple to manufacture and maintain. The fibers have high strength due to random microstructure which prevents axial cracking. This is true, even for fibers of large diameters. Strong large diameter continuous carbon fibers have not been available heretofore due to the difficulties in producing such fibers. Accordingly, this invention includes both continuous fibers which are strong and large in diameter, and the process of fiber preparation, which is useful for fibers of both large and small diameters.

SUMMARY OF THE INVENTION

Figure 1:
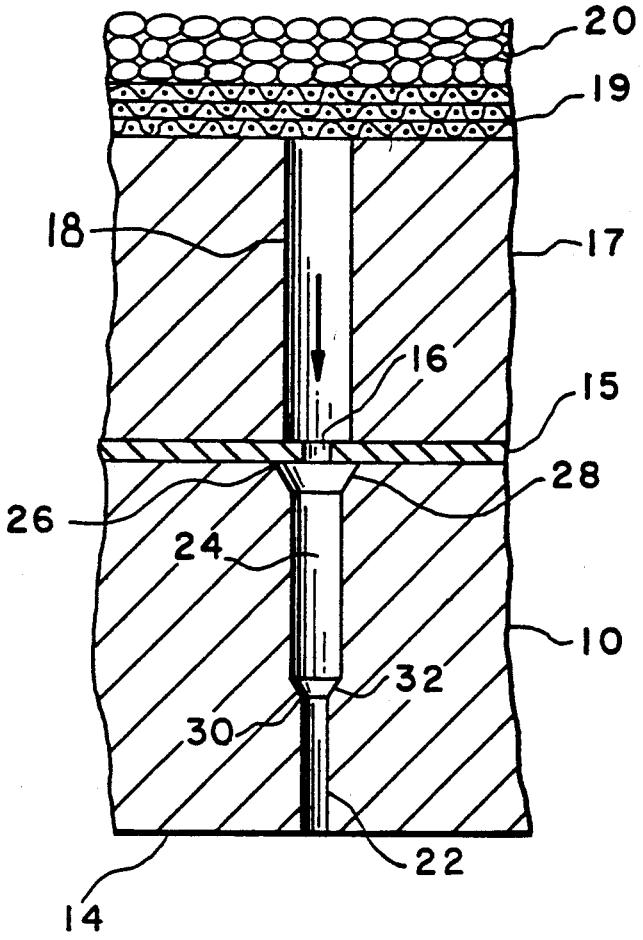
FIG. 1 is a partial schematic section of a melt spinning pack useful in the practice of this invention.

Axial cracking in substantially round carbon fibers can be avoided by use of the configuration of the conduit of this invention through which the pitch is spun. The process of this invention involves spinning mesophase pitch through a spinneret having a round cross-section discharge capillary and a round cross-section counterbore upstream of the capillary, the counterbore being larger in diameter than the capillary, the spinneret having at its inlet an opening which has a high aspect ratio. The opening may be trapezoidal, elliptical, a parallelogram, or the like, provided it is long and narrow. Rectangular openings are preferred. Aspect ratios (length divided by width of the opening) of at least than 3:1 are preferred, with ratios of at least 5:1 being more preferred. The opening must be larger than the cross-sectional area of the capillary. Ratios of these areas of at least 2:1 are preferred, with ratios of at least 8:1 more preferred. In a preferred process, the high aspect ratio opening has an area smaller than the cross-sectional area of the counterbore. The area of the opening is preferably from 10% to 70% of the area of the counterbore, and more preferably in the range of 25 to 45% of the area of the counterbore. For rectangular openings it is preferred that the length of the smaller side of the rectangle is approximately equal to the length of the diameter of the capillary of the spinneret.

Preferred openings have a depth of at least 0.005 inches with more preferred openings having a depth should be formed from a plate having a thickness selected so that at the spinning rate used, the pitch has an average residence time in the opening of at least 0.03 seconds. Residence times of 0.03 to 0.24 seconds are preferred with residence times in the range 0.06 to 0.20 seconds more preferred. However, the benefits of the invention are not lost if longer residence times are employed.

The process of this invention is sufficiently effective in preventing the formation of axial cracks in fibers that it can be used to prepare strong, continuous, substantially round cross-section, large diameter carbon fibers. These fibers have a diameter of from 30 to 100 micrometers and a strength after stabilization and carbonization of at least 375 Kpsi minus the diameter of the fiber in micrometers. Fibers having a diameter of 40 to 80 micrometers are preferred. Such large diameter fibers are useful in the reinforcement of metal, ceramic or plastic matrices.

DETAILED DESCRIPTION OF THE INVENTION

Figure 2:
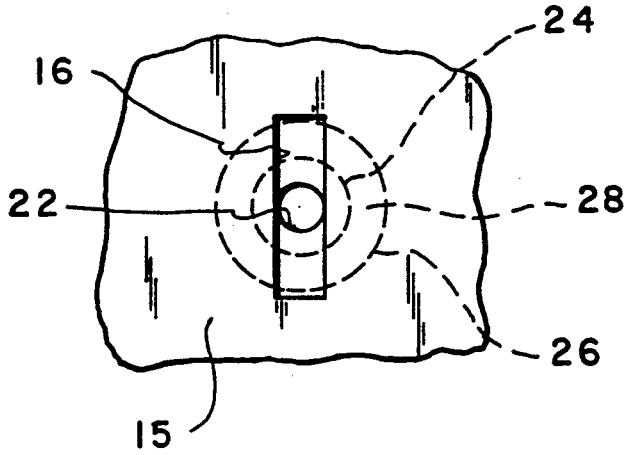
FIG. 2 is a view through the spinneret showing a rectangular opening to the spinneret.

The invention will be further explained by referring to the drawings. FIG. 1 shows in schematic cross-section a spinning pack useful in the practice of this invention. The pack consists of spinneret 10, shim 15, distribution plate 17 and screen pack 19 supporting filtration medium 20, which is described in U.S. Pat. No. 3,896,028 (Phillips). The screen and filtration medium are optional elements. Associated support, gasketing, heating and enclosing means are not shown in FIG. 1. Molten pitch supplied externally (means not shown) flows through the pack elements in the reverse order and is successively filtered through 20, is directed to one of a plurality of spinneret counterbores 24 via one of a plurality of coaxial holes 18 in distribution plate 17, passes through the opening 16 in shim 15 which forms the flow of pitch into a ribbon configuration. The pitch is then extruded through the spinneret capillary 22. Refinements in the spinneret 10 consist of wide entrance 26 which has tapering neck 28 leading to counterbore 24. Counterbore 24 communicates with capillary 22 via entrance 30 with tapering neck 32. FIG. 3 of U.S. Pat. No. 4,576,811 describes in detail the capillary entrance 30 and features within the tapering neck 32. Reference to FIG. 2 further details the alignment of high aspect ratio opening 16 (which in this preferred embodiment is rectangular) of shim 15 to the axis of capillary 22 in the spinneret 10. This arrangement is repeated for each of the many capillaries in the spinneret, and provides the beneficial formation of molten pitch flow into a ribbon configuration in its path from the distribution plate 17 to the spinneret 10. The pitch flow stream generally remains within a plane that includes the axis of the spinneret capillary 22. The drawings show a shim plate separate from the body of the spinneret used to provide the beneficial flow configuring opening. However other arrangements in which the high aspect ratio opening is incorporated in the spinneret body are within the scope of this invention.

It is preferred that the opening provide a reduction in cross-sectional area of pitch flow, as compared to the spinneret counterbore area, of about 10–70%, with from about 25 to 45% preferred. If the flow configuring opening is too wide (i.e., the shim opening has too low an aspect ratio) the benefits of the invention may not be obtained. If the flow restriction is too great (i.e., the shim opening is too narrow) process continuity may be impacted. The aspect ratio may be 25:1 or more, provided the continuous flow of pitch through the opening is not impeded. The rectangular geometry is the preferred flow configuration, but other configurations providing substantially ribbon-like flow may be used. An improvement in fiber properties is derived from the use of the high aspect ratio opening upstream from the spinneret, regardless of the thickness of the shim in which the opening is formed. However, fiber properties are optimized if the thickness of the shim, and hence the depth of the opening, is selected so that the average residence time of the pitch in the opening is at least 0.03 seconds. Preferred residence times are from 0.06 to 0.20 seconds, but longer residence times do not detract from the benefits of this invention. In general, a depth of at least 0.005 is preferred with 0.01 to 0.02 inches being more preferred. Equipment used to prepare pitch carbon fibers has in general evolved empirically from the larger body of melt-spinning art. Basic understanding has often lagged such development. What is understood, however, is that molten pitch, a discotic liquid crystalline material, has quite long relaxation times ("memory") relative to conventional organic polymers and that this property is very likely responsible for the beneficial results achieved by the practice of this invention.

The long relaxation time of pitch probably also accounts for a slight variation from circular cross-sections observed in fibers produced by the process of this invention. While the fibers are substantially round, the fibers, particularly the larger diameter fibers, spun through a rectangular opening upstream of the round spinneret exhibit a slight oval shape. They have an aspect ratio of 1.1 or less. That is, the longer dimension of the cross-section is 1.1 or less larger than the shorter dimension of the cross-section.

Subsequent to spinning in the manner described, fiber stabilization, carbonization and optional graphitization is carried out conventionally. Subsequent to preparing the as-spun or "green" filaments or yarns as described above, a finish (either fugitive or durable) may be applied to ease handling and/or provide protection. Stabilization in air is generally conducted between 250° and 380° C. and on bobbins (see, e.g., U.S. Pat. No. 4,527,754) preferably following the procedure disclosed in U.S. Pat. No. 4,576,810. Larger diameter fibers will require longer stabilization times; a useful "rule of thumb" is that one hour of stabilization time is required for each micron of larger fiber diameter. Accordingly, a 30 micron fiber would be stabilized for ca. 30 hours, at least to establish a point of reference in developing the optimum stabilization protocol for a fiber of that diameter. After stabilization, the yarns or fibers can be devolatilized or "precarbonized" in an inert atmosphere at temperatures between 800° and 1000° C. so that subsequent carbonization may proceed more smoothly and that formation of strength-limiting voids is reduced or eliminated entirely. Precarbonization is usually accomplished with 0.1 to 1 minute. Carbonization in inert atmosphere is carried out at 1000° to 2000° C. and preferably between 1500°–1950° C. for about 0.3 to 3 minutes. At this point a surface treatment and/or finish application may be beneficial to improve fiber performance, e.g., adhesion, in its eventual application, e.g.,in a composite. Graphitization, if desired, is usually accomplished in an inert atmosphere by heating between 2400° and 3300° C., preferably between 2600°–3000° C. for at least about a minute. During any of the abovementioned heating steps, longer times of treatment do not appear to be detrimental.

A plot of tensile strength versus diameter for carbon fibers of the prior art exhibits a curved line with high tensile strengths for small fibers, declining as fiber size is increased. For fiber diameters larger than 30 micrometers the curve flattens, but continues to trend downward as fiber diameter is increased. A plot of data for the large fibers of this invention provides a similar curve, roughly parallel to that for the prior art fibers, but with higher tensile strengths. Treating the graph for diameters of 30 micrometers and up as a straight line, the strength versus diameter relationship for the large diameter fibers of this invention is approximated by the equation, $S > \text{or} = 375 - D$. In this equation, S is strength in Kpsi, and D is fiber diameter in micrometers.

The invention will be more fully understood by reference to the following non-limiting examples

EXAMPLE 1

Midcontinent refinery decant oil was topped to produce an 850° F. plus residue. The residue analyzed 91.8% carbon, 6.5% hydrogen, 35.1% Conradson carbon residue and 81.6% aromatic carbon by $C^{13}$ NMR. The decant oil residue was heat soaked 6.3 hours at 740° F., and then vacuum deoiled to produce a heat soaked pitch. This pitch tested 16.4% tetrahydrofuran insolubles (1 gram pitch in 20 ml THF at 75° F.).

The pitch so obtained was pulverized, fluxed with toluene (1:1 weight ratio of solvent to pitch) by heating to the reflux temperature for about one hour. The solution was passed through a 1 micron filter, and admixed with sufficient toluene/heptane (98:2) ("anti-solvent") to provide (a) an 99:1 by volume toluene/heptane mixture and (b) an 8:1 mixed solvent/ pitch ratio, by volume/weight.

After refluxing for 1 hour, the mixture was cooled to ambient temperature and the precipitated solids were isolated by filtration. The cake was washed with additional anti-solvent followed by heptane and then dried. Several such batches were blended, melted at about 420° C., passed through a 2 micron filter, and extruded into pellets. At this point, the pitch pellets have a quinoline insolubles (ASTM 75° C.) of less than 0.1% by weight and are 100% mesophase, as determined by the polarized light microscopy method.

The pellets were remelted when fed to a screw extruder with an exit temperature of 350° C., spun at about 360° C. through a 4 inch diameter/480 hole spinneret. The holes are round and arrayed in 5 concentric rings (96 holes per ring) located in the outer ½ inch of the spinneret face. Each hole has a counterbore diameter of 0.055 inch, a capillary diameter of 200 microns, a capillary length of 800 microns (L/D equals 4), and an entrance angle of 80/60 degrees, as defined in Riggs et al. U.S. Pat. No. 4,576,811 (See particularly, Example 2). Between the spinneret and the distribution plate a 0.005 inch thick shim is interposed. The shim has a plurality of 0.008×0.10 inch slots that align with each spinneret hole as shown in FIG. 2. These slots form the pitch into a ribbon-shaped flow configuration to the spinnerets.

The spinneret is externally heated to about 360° C., and the spinning cell comprises an outer quench tube about 6 inches in diameter, 5 feet long, with top 6 inches screened to permit entry of quench air at room temperature. Aspiration is provided by a tapered (3 to 2½ inches) center column that is 4 inches long. A silicone oil finish supplied by Takemoto Oil and Fat Co. is applied to the air-cooled as-spun filaments or green fibers, which are wound at 550 yards per minute onto a spool disclosed in U.S. Pat. No. 4,527,754 (Flynn).

Several spool packages, each containing about 1 pound of yarn, were batch stabilized by heating in air. All were heated to 170° C. for 80 minutes. The temperature was then increased in stages to 245° C. over several hours, then held at 245° C. for an additional period of almost 2 hours.

Carbonization was carried out by combining the yarn from 6 stabilized packages mounted in a creel to form a 2880 filament tow (nominally "3K") forwarded at 12 feet/minute under the tension of its own weight (about 150 grams) through a 4 foot long precarbonization oven at 600–800° C., then through a 9 foot long, carbon-resistance oven having a 1000°–1200° C. entrance zone, a 1950° C. carbonization zone, and an exiting 1000°–1200° C. zone The fibers were at carbonization temperatures for about 1 minute. The carbonized yarn was next passed through a 19 foot long chamber containing dried, room temperature air admixed with 0.098% (980 ppm) of ozone supplied at a rate of 1 cfm. The yarns are overlayed with a 1% solution of epoxy resin (CMD-W55-5003, sold by the Celanese Corporation) in water, using the method and apparatus shown in U.S. Pat. No. 4,624,102 (Bell, Jr.). The thus treated yarns were cured at 350° C. and then cleaned by passing the yarn through the guide described and illustrated in U.S. Pat. No. 4,689,947 (Winckler). Ten representative bobbins of the carbonized yarn so produced were selected and single fiber tensile properties were determined at 1" gauge length following ASTM 3379 on 10 samples from each bobbin (average diameter was 9.4 microns). The average resulting properties were 478 Kpsi strength, 52 Mpsi modulus and 0.9% elongation. Less than 1% of the filaments observed in photomicrographic cross-section of the yarn bundles showed signs of longitudinal cracking The microstructure of the individual filaments was in all cases random, an unusual level of microstructural control and homogeneity.

Ten representative bobbins of carbonized yarn produced and characterized as above but were made from a different batch of the same type of pitch without the slotted shim produced the following average properties: diameter 9.3 micron, 418 Kpsi strength, 53 Mpsi modulus and 0.7% elongation. These are appreciable differences. In addition, 33% of the filaments observed in photomicrographic cross-sections of the yarn bundles showed signs of longitudinal cracking. The observed microstructure was generally radial in character.

EXAMPLE 2

The above example was repeated, with the following changes: a different batch of the same type of pitch was used and a different amount of "antisolvent" was employed, such that the resulting mixture was 90:10 by volume of toluene/heptane.

The result of this change was that the pitch had a "predicted spin temperature" of 355° C. vs.346° C. for the pitch used in Example 1. The "predicted spin temperature" is the temperature at which the pitch exhibits a melt viscosity of 630 poises, measured using an Instron capillary viscometer. In addition: the spinneret had 500 holes (vs. 480); and the entrance angle was 135 degrees (vs. 80/60).

The fibers were carbonized as in Example 1 then graphitized using the same equipment run such that the residence time at the highest temperature (2550° C.) was about 30 seconds. Resulting graphite fibers averaged (25 breaks/2 bobbins) 609 Kpsi strength, modulus 135 Mpsi and elongation was 0.55% No longitudinal cracking was observed; the microstructure was "random".

EXAMPLE 3

Example 1 can be repeated as follows: Pitch similar to that used in Example 1 is employed. The spinneret bores have the same configuration as in example 1 but are twice as large (i.e., the capillary is 0.016 in. in diameter, etc.). The shim opening is rectangular and 0.010 in. wide and 0.005 inches in depth. Fibers spun will have a diameter of 48 micrometers and a strength greater than 327 Kpsi. Microscopic examination of the cross-section of the fibers will reveal random microstructure, and the fibers will have little or no axial cracking.

EXAMPLE 4

Example 2 was repeated with the following changes. A different batch of a similar type of pitch was used. The pitch had a different amount of antisolvent (85:15), such that the resulting mixture had a 87:13 toluene:heptane volume ratio and the pitch had a predicted spin temperature of 355° C.

The 0.008×0.10 inch slots were cut in shims having a thickness reported in the table below, and the spinneret used had an entrance angle of 130°.

Carbonization was carried out with a 500-filament tow, then graphitized at 2670° C. using the same equipment so that the residence time at the highest temperature was about 30 seconds.

Fiber tensile properties were measured according to ASTM 3379, and average values for 10 samples are shown below.

| SHIM DEPTH IN. | RESIDENCE SECONDS | FIBER DIA. MICRONS | TENSILE STRENGTH KPSI | MODULUS MPSI | ELONGATION % |
|---|---|---|---|---|---|
| 0.015 | 0.20 | 9.1 | 560 | 136 | 0.5 |
| 0.010 | 0.14 | 8.9 | 534 | 131 | 0.5 |
| 0.005 | 0.07 | 8.5 | 494 | 122 | 0.5 |

We claim:

1. In a process for spinning substantially round carbon fibers from pitch comprising extruding molten mesophase pitch through a spinneret having a round cross-section discharge capillary and a round cross-section counterbore upstream of the capillary, said counterbore being larger in diameter than the capillary, the improvement comprising first directing the flow of molten pitch through an opening upstream of the counterbore, said opening having an aspect ratio of at least 3:1 and an area substantially larger than the cross-sectional area of the capillary.

2. The process of claim 1 wherein the aspect ratio of the opening is at least 5:1.

3. The process of claim 2 wherein the opening is rectangular.

4. The process of claim 2 or 3 wherein the pitch has an average residence time in the opening of at least 0.03 seconds.

5. The process of claim 2 or 3 wherein the opening has a depth of at least 0.005 inches.

6. The process of claim 1, 2, or 3 wherein the ratio of the area of the opening to the area of the capillary is at least 2:1, and wherein the pitch has an average residence time in the opening of at least 0.03 seconds.

7. The process of claim 1, 2, or 3 wherein the ratio of the area of the opening to the area of the capillary is at least 8:1, and wherein the pitch has an average residence time in the opening of at least 0.03 seconds.

8. The process of claim 1, 2, or 3 in which the opening at the inlet of the spinneret has an area of from 10 to 70% of the cross-sectional area of the counterbore, and the ratio of the area of the opening to the area of the capillary is greater than 2:1, and the pitch has an average residence time in the opening of at least 0.03 seconds.

9. The process of claim 1, or 2, in which the opening at the inlet of the spinneret is rectangular and has an area of from 25 to 45% of the cross-sectional area of the counterbore, and the ratio of the area of the opening to the area of the capillary is greater than 8:1, and in which the small dimension of the rectangular opening is approximately equal to the diameter of the capillary, and wherein the pitch has an average residence time in the opening of at least 0.03 seconds.

10. The process of claims 1, 2, or 3 wherein the fiber has a diameter of from 30 to 100 micrometers.

11. The process of claims 1, 2, or 3 wherein the fiber has a diameter of from 40 to 80 micrometers.

* * * * *